US010603679B2

(12) United States Patent
Yang

(10) Patent No.: US 10,603,679 B2
(45) Date of Patent: Mar. 31, 2020

(54) HYGIENIC SPRAY DEFLECTOR APPARATUS AND METHODS

(71) Applicant: Sani-Matic, Inc., Madison, WI (US)

(72) Inventor: Solo Yang, Fort Atkinson, WI (US)

(73) Assignee: SANI-MATIC, INC., Madison, WI (US)

( * ) Notice: Subject to any disclaimer, the term of this patent is extended or adjusted under 35 U.S.C. 154(b) by 206 days.

(21) Appl. No.: 15/585,728

(22) Filed: May 3, 2017

(65) Prior Publication Data

US 2018/0318851 A1 Nov. 8, 2018

(51) Int. Cl.

| | |
|---|---|
| ***B05B 1/26*** | (2006.01) |
| ***B08B 9/093*** | (2006.01) |
| ***B08B 9/00*** | (2006.01) |
| ***B05B 12/32*** | (2018.01) |
| *B05B 13/06* | (2006.01) |

(52) U.S. Cl.

CPC ..... *B05B 1/262* (2013.01); *B05B 12/32* (2018.02); *B08B 9/00* (2013.01); *B08B 9/093* (2013.01); *B05B 13/0627* (2013.01)

(58) Field of Classification Search

CPC ..... B05B 1/26–267; B05B 12/32–36; B05B 13/0627; B08B 9/00; B08B 9/08; B08B 9/0813; B08B 9/093–0936; B08B 3/02; B08B 3/04; B08B 3/08; B08B 3/10

USPC ..... 134/22.1, 22.18

See application file for complete search history.

(56) References Cited

U.S. PATENT DOCUMENTS

| | | | | |
|---|---|---|---|---|
| 1,841,691 | A * | 1/1932 | Wilson | B60K 15/03504 220/371 |
| 3,152,604 | A * | 10/1964 | Frye | F16K 24/042 137/202 |
| 3,935,974 | A * | 2/1976 | Weyn | B65D 83/30 222/402.13 |
| 4,941,493 | A * | 7/1990 | Wieringa | B08B 9/093 134/102.3 |
| 6,145,756 | A * | 11/2000 | Kohls | B05B 1/28 239/288 |
| 9,200,718 | B2 * | 12/2015 | Cardia | F16K 1/427 |
| 2005/0187122 | A1 * | 8/2005 | Staub | B05B 1/14 510/247 |
| 2006/0207015 | A1 * | 9/2006 | DeBoer | B05B 1/205 4/615 |
| 2009/0178812 | A1 * | 7/2009 | Solomon | A62C 5/008 169/14 |

* cited by examiner

*Primary Examiner* — Cody J Lieuwen
(74) *Attorney, Agent, or Firm* — Foley & Lardner LLP

(57) ABSTRACT

A hygienic spray deflector apparatus includes an inlet opening, an outlet opening, and at least one wall that encloses a space between the inlet opening and the outlet opening. The hygienic spray deflector further includes a spray deflector in the space between the inlet opening and the outlet opening. The spray deflector is configured to deflect fluid that enters the hygienic spray deflector through the inlet opening. The hygienic spray deflector further includes a connector between the spray deflector and the at least one wall. The connector is configured to fix the spray deflector in place within the space. The connector is configured to allow air flow between the inlet opening and the outlet opening.

13 Claims, 5 Drawing Sheets

400

HYGIENIC SPRAY DEFLECTOR APPARATUS AND METHODS

BACKGROUND

Tanks or fluid storage vessels are often used for storing fluids such as liquids, gases, and even solid matter. Such storage vessels not only store such various substances, but are also often rinsed or cleaned using a variety of substances and methods. For example, a tank may be with water or cleaned with a chemical. In such examples, the inside of the storage vessel can be sprayed with the water, chemical, or other fluid.

SUMMARY

In one aspect, a hygienic spray deflector apparatus is provided that includes an inlet opening, an outlet opening, and at least one wall that encloses a space between the inlet opening and the outlet opening. The hygienic spray deflector further includes a spray deflector in the space between the inlet opening and the outlet opening. The spray deflector is configured to deflect fluid that enters the hygienic spray deflector through the inlet opening. The hygienic spray deflector further includes a connector between the spray deflector and the at least one wall. The connector is configured to fix the spray deflector in place within the space. The connector is configured to allow air flow between the inlet opening and the outlet opening.

In another aspect, a hygienic spray deflection system is provided including a fluid storage vessel having a vent, a spray device (in some embodiments this may be referred to as a spray ball) inside the fluid storage vessel, and a hygienic spray deflector attached to the vent. The hygienic spray deflector includes an inlet opening connected to the vent, an outlet opening, and at least one wall that encloses a space between the inlet opening and the outlet opening. The hygienic spray deflector further includes a spray deflector in the space between the inlet opening and the outlet opening. The spray deflector is configured to deflect fluid that enters the hygienic spray deflector through the inlet opening. The hygienic spray deflector further includes a connector between the spray deflector and the at least one wall. The connector is configured to fix the spray deflector in place within the space. The connector is configured to allow air flow between the inlet opening and the outlet opening.

In further aspect, a method for deflecting spray fluid back into a fluid storage vessel is provided, the method includes spraying fluid out of a spray device into a fluid storage vessel having a vent. The method further includes positioning a hygienic spray deflector at the vent of the fluid storage vessel. The hygienic spray deflector is configured to deflect the fluid sprayed from the spray device that enters the vent back into the fluid storage vessel. The hygienic spray deflector is further configured to allow air flow between an inside of the fluid storage vessel and an outside of the fluid storage vessel via the vent.

BRIEF DESCRIPTION OF THE DRAWINGS

Illustrative embodiments will hereafter be described with reference to the accompanying drawings.

DETAILED DESCRIPTION

Figure 1:
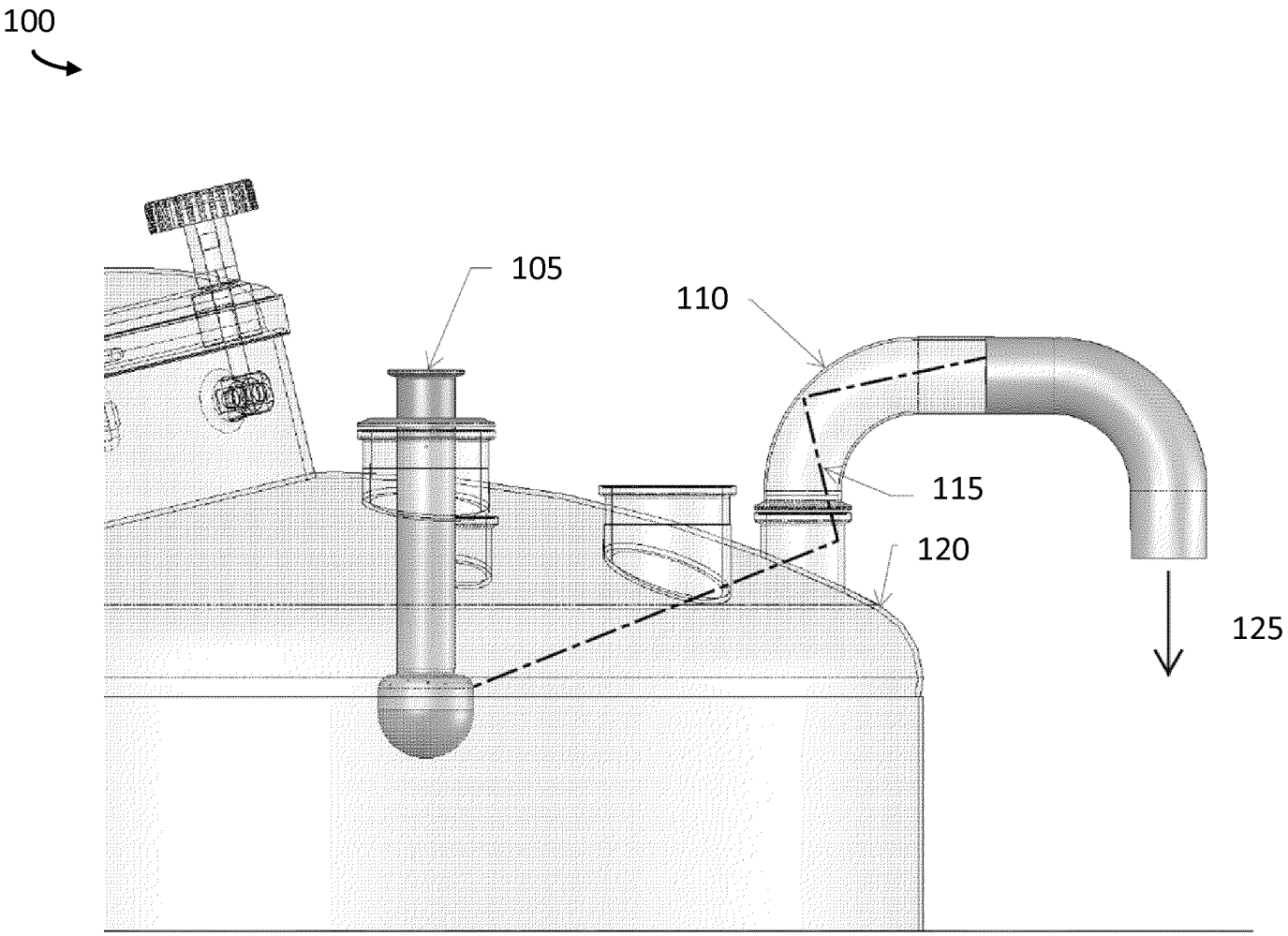
FIG. 1 is a representation of a fluid storage vessel with a spray device and a vent.

Various embodiments are described hereinafter. It should be noted that the specific embodiments are not intended as an exhaustive description or as a limitation to the broader aspects discussed herein. One aspect described in conjunction with a particular embodiment is not necessarily limited to that embodiment and can be practiced with any other embodiment(s).

As used herein, "about" will be understood by persons of ordinary skill in the art and will vary to some extent depending upon the context in which it is used. If there are uses of the term which are not clear to persons of ordinary skill in the art, given the context in which it is used, "about" will mean up to plus or minus 10% of the particular term.

The use of the terms "a" and "an" and "the" and similar referents in the context of describing the elements (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the embodiments and does not pose a limitation on the scope of the claims unless otherwise stated. No language in the specification should be construed as indicating any non-claimed element as essential.

Described herein are illustrative embodiments for an apparatus, system, and methods for a hygienic spray deflector (which may alternatively be referred to as a vent spray deflector). The hygienic spray deflector as described herein is to prevent, or at least minimize, fluids from leaking out of a vent of a storage vessel during cleaning or filling operations. A storage vessel may also be referred to as a tank. Storage vessels often have vents so that air can circulate between the inside of the storage vessel and the outside. However, when spraying the inside of the storage vessel, fluid can escape through the vent. This could necessitate additional maintenance to a facility because of the fluid escaping. The escaped fluid may also be lost, increasing the amount of fluid used for spraying down or filling the storage vessel, which in turn can increase operating costs. In addition, if the fluid used to spray down or fill the storage contains chemicals, escaped liquids can cause a safety hazard that requires additional work to properly capture and/or dispose of escaped fluid. Advantageously, by keeping the fluid inside the storage vessel using the hygienic spray deflector disclosed herein, the fluid directed back inside the storage vessel can be recaptured and/or reused in certain applications. The hygienic spray deflectors may find application in the medical or pharmaceutical field, beverage industry, or any other industry where storage or other tank systems are used that requiring cleaning and or filling as described herein. One illustrative example where such storage vessels may be used is in the sanitation or cleaning of pharmaceutical or biopharmaceutical media. Such media may be placed inside the storage vessel and subsequently sprayed down to sanitize or clean it. Such are illustrative only and are not limiting, as the various embodiments disclosed herein may be used with other storage vessels that may be used for different or similar purposes.

FIG. 1 is a representation 100 of a fluid storage vessel 120 with a spray device 105 and a vent 110. In alternative embodiments, fewer, additional, and/or different components may be included. FIG. 1 does not include a hygienic spray deflector. The spray device 105 can be configured to spray fluid into the fluid storage vessel 120. The lower part of the spray device 105 that is inside the fluid storage vessel has a hemispherical shaped section with holes in it, such that fluid can be sprayed at all parts of the inside of the fluid storage vessel 120. In this manner, the inside of the fluid storage vessel 120 can be sprayed down. However, at least some fluid, such as the fluid that moves from the spray device 105 in the direction of a fluid path 115, may escape the fluid storage vessel 120 through the vent 110. The fluid can then escape the vent at 125.

As discussed above, escaping fluid can be problematic: such fluid may be wasted, cause a safety hazard, and may be difficult or problematic to clean up or otherwise dispose of. Due to the pressure of the fluid coming out of the spray device 105, extending the size or shape of the vent 110 may not adequately keep fluid from escaping the fluid storage vessel 120. Excessive fluid escaping from the fluid storage vessel 120 may also necessitate drains and associated piping in a facility, further increasing the cost and complexity of dealing with the escaping fluid. Closing the vent to prevent fluid escaping prevents the fluid storage vessel 120 from being properly ventilated, as is often desirable or required. Another way to prevent fluid from escaping is configuring the spray device 105 to intentionally not spray fluid toward the vent 110. However, such a solution runs the risk of not completely rinsing the fluid storage vessel 120, and creating additional work in configuring the spray device 105 and orienting it properly within the fluid storage vessel 120 to avoid spraying fluid at the vent 110.

Figure 2:
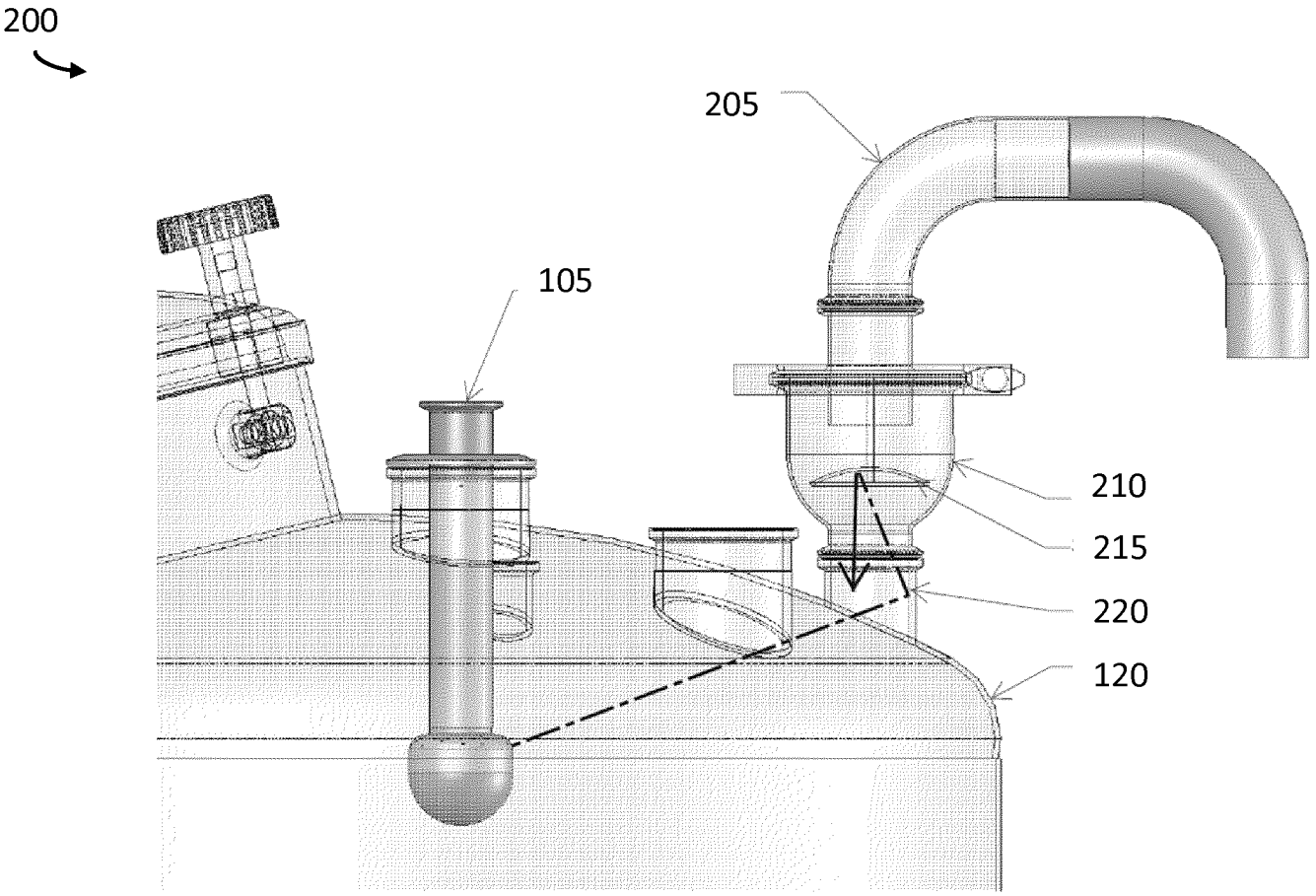
FIG. 2 is a representation of a fluid storage vessel with a spray device, a vent, and a hygienic spray deflector in accordance with an illustrative embodiment.

FIG. 2 is a representation 200 of a fluid storage vessel 120 with a spray device 105, a vent 205, and a hygienic spray deflector 210 in accordance with an illustrative embodiment. In alternative embodiments, fewer, additional, and/or different components may be included. In FIG. 2, the hygienic spray deflector 210 is inserted as part of the vent 205 for the fluid storage vessel 120. The hygienic spray deflector 210 includes a spray deflector 215 that deflects fluid that enters the space within hygienic spray deflector 210 housing. The spray deflector 215 is located over an inlet opening of the hygienic spray deflector 210, such that fluid coming into the hygienic spray deflector 210 from the fluid storage vessel 120 can be deflected by the spray deflector 215. The spray deflector 215 has a concave shape that faces the inlet opening of the hygienic spray deflector 210. A fluid path 220 shows how fluid from the spray device 105 may be deflected back into the fluid storage vessel 120. Fluid may also be deflected onto the inner walls of the hygienic spray deflector 210. That fluid can then drain back into the fluid storage vessel 120 due to gravity and the shape of the hygienic spray deflector 210.

Advantageously, the hygienic spray deflector 210 is removable or separable from the fluid storage vessel 120 and the vent 205. In this way, the hygienic spray deflector 210 can be removed for cleaning, such as immersion cleaning. Additionally, the hygienic spray deflector 210 can be used on existing fluid storage vessels that were designed to be fitted to a standard vent. In alternative embodiments, the hygienic spray deflector 210 may be permanently attached to the fluid storage vessel 120 and/or the vent 205 piping.

The hygienic spray deflector 210 may be used on any type of tank or storage vessel with a vent. The tank or storage vessel may be equipped with a spray device such as the one shown in FIGS. 1 and 2, or may have a different spraying apparatus. The hygienic spray deflector 210 may be different sizes or shapes depending on the application and the tanks/vessels and venting piping that the hygienic spray deflector 210 is used with. The spray deflector 215 is a disk shape that is concave facing toward the inlet opening of the hygienic spray deflector 210. In various embodiments, other shapes, orientations, and curvatures are contemplated.

In various embodiments, a fluid storage vessel, such as the fluid storage vessel 120, may also be equipped with a vent system that has a filter housing and filter. In such embodiments, that filter can help maintain hygienic conditions within the tank or fluid storage vessel. For example, a filter housing and filter could exist in between the hygienic spray deflector 210 and the vent 205 piping. In some embodiments, the filter housing and filter may be incorporated into the vent 205 piping of FIG. 2. Configuring the filter housing and filter in these ways advantageously helps reduce any fluid spray from wetting a filter. When such a filter gets wet, it can reduce air flow through the filter (and subsequently in and out of the tank). Accordingly, wetting of the filter is undesirable, and the hygienic spray deflectors as disclosed herein can provide the added benefit of preventing wetting of a filter.

Figure 3C:
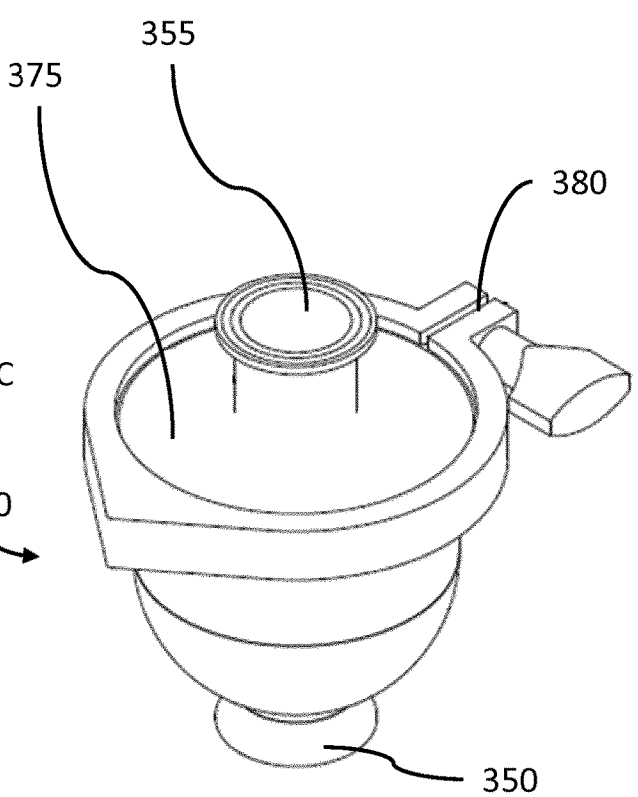
FIG. 3C is a representation of an isometric view of a hygienic spray deflector in accordance with an illustrative embodiment.
Figure 3A:
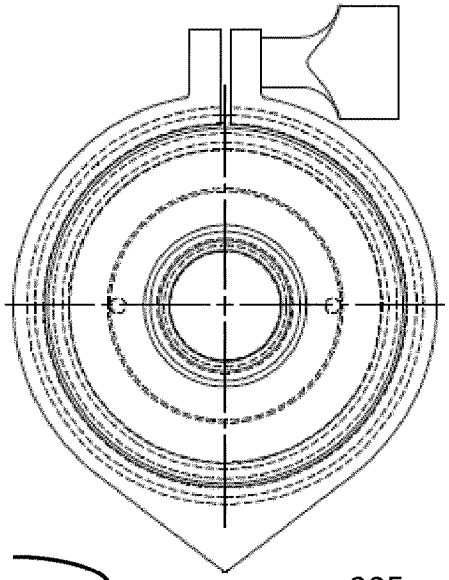
FIG. 3A is a representation of a top view of a hygienic spray deflector in accordance with an illustrative embodiment.
Figure 3B:
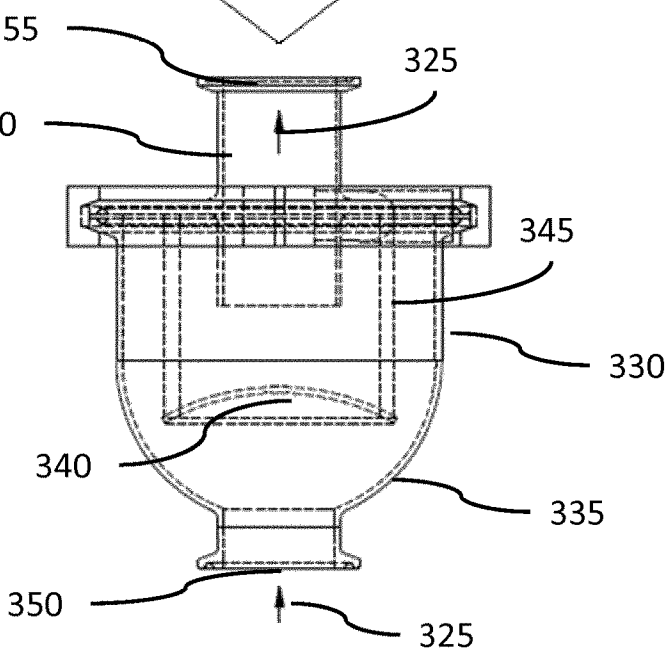
FIG. 3B is a representation of a side view of a hygienic spray deflector in accordance with an illustrative embodiment.

FIG. 3A is a representation 300 of a top view of a hygienic spray deflector in accordance with an illustrative embodiment. FIG. 3B is a representation 320 of a side view of a hygienic spray deflector in accordance with an illustrative embodiment. FIG. 3C is a representation 370 of an isometric view of a hygienic spray deflector in accordance with an illustrative embodiment. In alternative embodiments, fewer, additional, and/or different components may be included. The hygienic spray deflector of FIGS. 3A, 3B, and 3C can be used with a storage vessel and vent as described above and shown with respect to FIG. 2.

The hygienic spray deflector includes an inlet opening 350 and an outlet opening 355. The "in" of the inlet opening 350 and the "out" of the outlet opening 355 are indicated by arrows 325. However, these terms are not meant to be limiting as fluids such as air and liquids can pass in or out of the hygienic spray deflector through either the inlet opening 350 or the outlet opening 355. The inlet opening 350 is configured to attach to a fluid storage vessel. For example, the fluid storage vessel 120 of FIG. 2 may have a vent opening that the inlet opening 350 is shaped to fit. The outlet opening 355 is configured to attach to a vent structure. For example, the outlet opening 355 may be configured to attach to the vent 205 piping of FIG. 2. In an alternative embodiment, the outlet opening 355 may constitute the end of vent piping, such that the outlet opening 355 does not attach to additional piping.

The hygienic spray deflector also includes at least one wall 330 that encloses a space between the inlet opening and the outlet opening. In the hygienic spray deflector of FIGS. 3A-3C, the at least one wall includes a cylindrical shaped wall that decreases in diameter (and radius) at points closer to the inlet opening 350. In this way, fluid in the space between the inlet opening and the outlet opening can take advantage of gravitational forces to flow downward back toward a fluid storage vessel after being deflected by a spray deflector 340. For example, the cylindrical wall may have a first diameter at a first point 335 and a second diameter at a second point corresponding to where the cylindrical wall and a connector wall meet. Accordingly the first point is closer to the inlet opening 350 than the second point, and the first diameter is smaller than the second diameter. In another example, the first point may coincide with the inlet opening 350, and at that point may have the smallest diameter of any part of the cylindrical wall.

The spray deflector 340 exists in the space between the inlet opening 350 and the outlet opening 355. The spray deflector 340 is designed to deflect fluid that enters the hygienic spray deflector through the inlet opening 350. The fluid can then be deflected directly back through the inlet opening 350, or may be deflected onto the at least one wall 330 such that the fluid can drain back through the inlet opening 350.

The hygienic spray deflector also includes connectors 345 between the spray deflector 340 and the at least one wall 330. The connectors 345 fix the spray deflector 340 in place within the space between the inlet opening 350 and the outlet opening 355. The connectors are designed to still allow air flow between the inlet opening 350 and the outlet opening 355. In FIG. 3B, the connectors 345 are attached to the connector wall 375, as shown in FIG. 3C. For purposes of this disclosure, the connector wall 375 is one of the at least one wall 330 that encloses the space between the inlet opening 350 and the outlet opening 355. In various embodiments, the at least one wall 330 may comprise any number of walls or surfaces that enclose the space housing the spray deflector 340. The specific shape shown in FIGS. 3A-3C is shows just one possible embodiment for implementing the walls that could be used to enclose such a space.

The connectors 345 may be advantageously connected or attached between the spray deflector 340 and the connector wall 375. In particular, the connectors 345 are oriented is such a way as to be oriented generally parallel to the direction of flow of fluid into the inlet opening 350 (generally parallel to, for example, the arrows 325). In this way, the connectors 345 supporting the spray deflector 340 can better withstand any forces of fluid being deflected by the spray deflector 340. Additionally, such an orientation may reduce the size of the connectors 345 compared to connectors that were, for example, connected to the spray deflector 340 in an orientation generally normal to the direction of flow of fluid into the inlet opening 350. This can advantageously save on material costs and improve total air flow through the hygienic spray deflector.

The spray deflector 340 is a disk having a concave shape oriented toward the inlet opening 350 and a convex shape oriented toward the outlet opening 355. The concave shape of the disk advantageously provides deflection of fluids back toward the inlet opening 350. The concave shape generally provides for deflections of liquid back toward the inlet opening 350 similar to a parabolic reflector. In various embodiments, the shape of the spray deflector 340 may be adjusted to be more or less paraboloid shaped or may be curved or shaped in other ways.

The spray deflector 340 is shaped to have an area that is larger than an area of the inlet opening 350. The area of the spray deflector 340 may also be larger than the outlet opening 355 area. The spray deflector 340 is shaped to have an area larger than the inlet opening 350 so that fluid that comes through the inlet opening 350 can be deflected. Even if fluid comes into the hygienic spray deflector at a high incidence angle (e.g., not generally parallel to the arrows 325), the fluid can be deflected because of the shape of the spray deflector 340. Where the spray deflector 340 area is larger than the outlet opening 355, this helps prevent fluid from escaping out of the outlet opening 355. With respect to the diameters at different points of the cylindrical wall described above that may form part of the at least one wall 330, the spray deflector 340 has a diameter that is larger than the first diameter (point closer to or coinciding with the inlet opening along the cylindrical wall), but smaller than the second diameter (the widest point of the cylindrical wall).

The hygienic spray deflector also includes an outlet pipe 360 located at the outlet opening 355. A portion of the outlet pipe 360 forms the outlet opening 355 and the outlet pipe 360 extends into the space formed by the at least one wall 330 between the inlet opening 350 and the outlet opening 355. By extending into the space beyond the outlet opening 355, less fluid can escape through the outlet opening 355. A first diameter of the outlet pipe 360 is smaller than the diameter of the cylindrical wall at a point closer to the outlet opening 355 such that at least a portion of the outlet pipe 360 is in the space within the cylindrical wall. The connector wall 375 extends from an outer surface of the outlet pipe 360 to the cylindrical wall. This configuration also helps prevent fluid from escaping the hygienic spray deflector. If any fluid gets around and above the spray deflector 340, it is likely to hit the cylindrical wall, the connector wall 375, and/or the outer surface of the outlet pipe 360 that is within the enclosed space, rather than pass through the inside of the outlet pipe 360 and escape through the outlet opening 355.

The hygienic spray deflector may also be constructed in different ways. For example, the cylindrical wall and inlet opening 350 may be a single piece that is joined together with a piece including the outlet opening 355, the outlet pipe 360, the connector wall 375, the connectors 345, and the spray deflector 340. The two pieces can be joined together using a gasket and clamp 380. The gasket may be, for example, any elastomer such as platinum cured silicone, EPDM, Viton, Teflon, Buna, or otherwise suitable material. The clamp may be, for example, a standard hinge clamp, a double bolted clamp, a three-piece clamp, or other suitable device. Advantageously, a piece having the spray deflector may be compatible with varying inlet opening pieces. Accordingly, in this embodiment, to fit a hygienic spray deflector to tanks with different vent sizes, only varying pieces with the inlet opening need to be formed, while uniform pieces with the spray deflector can be used. In other embodiments, the outlet opening 355 may be configured to fit vent piping, such as the vent 205 piping of FIG. 2.

FIGS. 3A-3C show an illustrative embodiment, different shapes, configurations, and sizes of aspects of the hygienic spray deflector are contemplated and fall within the scope of this disclosure. For example, the walls may be a polygon shape rather than a cylindrical shape. The inlet and outlet openings may also vary by shape and size, rather than being circular and the same size. For example, in some embodiments, the outlet opening may be smaller than the inlet opening to further help prevent fluid from escaping through the outlet opening. The spray deflector may also vary in shape and size. Discussed below and with respect to FIG. 4 are additional embodiments contemplated herein.

Figure 4:
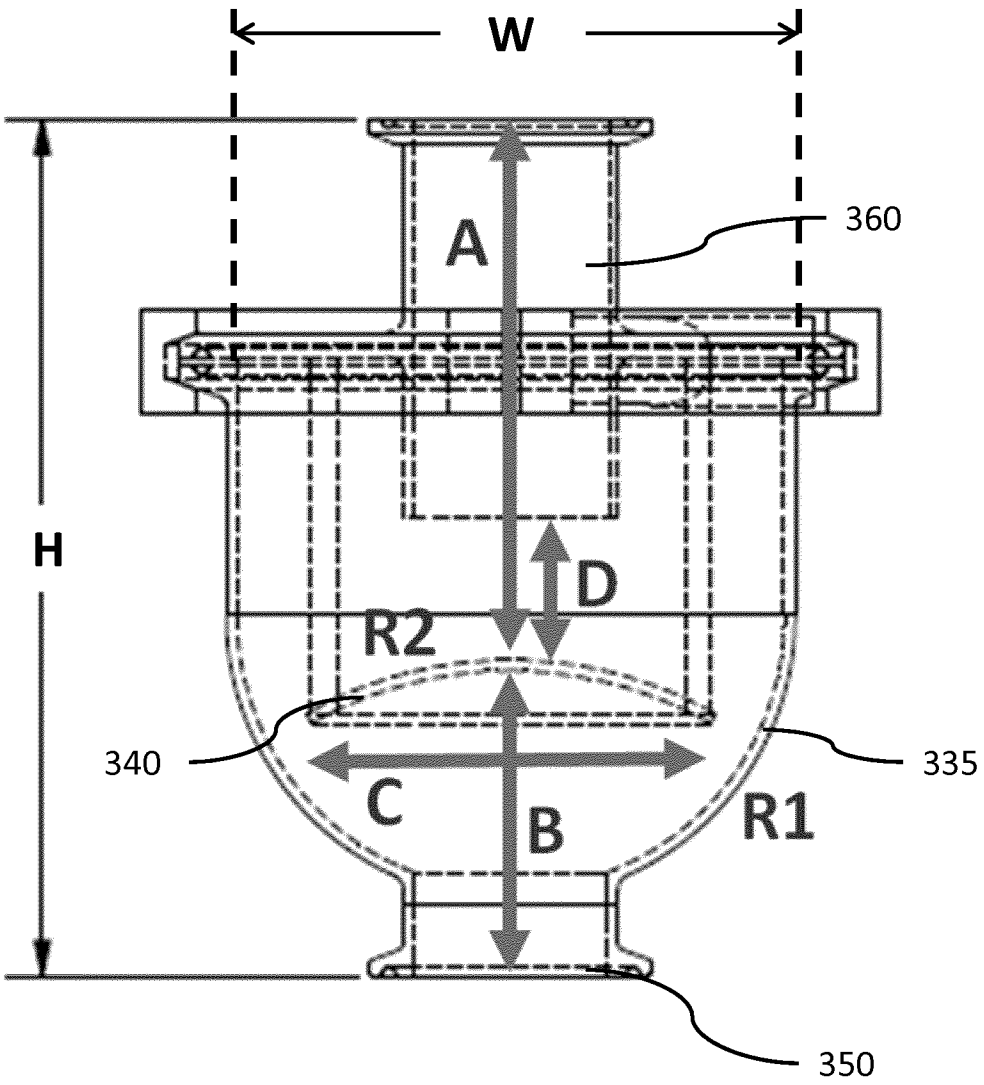
FIG. 4 is another representation of a side view of a hygienic spray deflector in accordance with an illustrative embodiment.

FIG. 4 is another representation 400 of a side view of a hygienic spray deflector in accordance with an illustrative embodiment. In alternative embodiments, fewer, additional, and/or different components may be included. The representation shows various dimensions or aspects of the hygienic spray deflector that may be varied or configured for various applications or uses.

Although various dimensions are disclosed herein, such dimensions are merely examples, and any size or configuration for a hygienic spray deflector is contemplated herein. A height H of the hygienic spray deflector may be about 6". In various embodiments, the height H may be anywhere from 3" to 12", such as 3", 3.5", 4", 4.5", 5", 5.5", 6", 6.5", 7", 7.5", 8", 8.5", 9", 9.5", 10", 10.5", 11", 11.5", or 12". A distance A between the outlet opening and the top of the spray deflector may be about 3.8" In various embodiments, the distance A may be anywhere from 1" to 9", such as 1", 1.5", 2", 2.5", 3", 3.5", 4", 4.5", 5", 5.5", 6", 6.5", 7", 7.5", 8", 8.5" or 9".

A distance D between the bottom of the outlet pipe and the top of the spray deflector may be about 1". In various embodiments, the distance D may be anywhere from 0.25" to 3", such as 0.25", 0.5", 0.75", 1", 1.25", 1.5", 1.75", 2", 2.25", 2.5", 2.75" or 3". A diameter C of the spray deflector may be about 2.9". In various embodiments, the diameter C may be anywhere from 0.5" to 9", such as 0.5", 1", 1.5", 2", 2.5", 3", 3.5", 4", 4.5", 5", 5.5", 6", 6.5", 7", 7.5", 8", 8.5", or 9". A radius R2 of the spray deflector hemisphere may be about 3". In various embodiments, the radius R2 may be anywhere from 1" to 6", such as 1", 1.5", 2", 2.5", 3", 3.5", 4", 4.5", 5", 5.5", or 6".

A radius R1 of the of the body hemisphere (formed by the at least one wall) may be about 2". This radius R1 can define how quickly, for example, the diameter of a cylindrical wall as described above with respect to FIGS. 2 and 3A-3C changes as the wall gets closer to the inlet opening. In various embodiments, the radius R2 may be anywhere from 0" to 6", such as 0", 0.5", 1", 1.5", 2", 2.5", 3", 3.5", 4", 4.5", 5", 5.5", or 6". A distance B of between the top of the concave surface of the spray deflector and the inlet opening may be about 2.1". In various embodiments, the distance B may be anywhere from 0.5" to 6", such as 0.5", 0.75", 1", 1.25", 1.5", 1.75", 2", 2.25", 2.5", 3", 3.25", 3.5", 3.75", 4", 4.25", 4.5", 4.75", 5", 5.25", 5.5", 5.75", or 6".

A body width W of the hygienic spray deflector may be about 4". In various embodiments, the body width W may be anywhere from 3" to 12", such as 3", 3.5", 4", 4.5", 5", 5.5", 6", 6.5", 7", 7.5", 8", 8.5", 9", 9.5", 10", 10.5", 11", 11.5", or 12". The connection sizes at the inlet and outlet openings may be about 1.5". In various embodiments, the connections sizes may be anywhere from 0.25" to 6", such as 0.25", 0.5", 0.75", 1", 1.25", 1.5", 1.75", 2", 2.25", 2.5", 3", 3.25", 3.5", 3.75", 4", 4.25", 4.5", 4.75", 5", 5.25", 5.5", 5.75", or 6".

The connection types may be tri-clamps, DIN fittings, tube butt welds, or any other suitable type of connection for connecting the hygienic spray deflector to a fluid storage vessel and/or vent piping. The connections may also include elastomers such as those used for the gasket described above. The various aspects of the hygienic spray deflector may be made out of various materials with various finishes. For example, the hygienic spray deflector may be made out of a stainless steel such as 316L stainless steel, 304 stainless steel, Hastelloy, Duplex, or other alloys; polymers; ceramics, and the like. The inner surfaces of the hygienic spray deflector (exposed to fluid and corresponding to the enclosed space) may have a roughness finish of 15 μ-in Ra, 20 μ-in Ra, 25 μ-in Ra, or anywhere in between 0 μ-in Ra and 32 μ-in Ra. The outer surfaces of the hygienic spray deflector may have a roughness finish of 32 μ-in Ra, 15 μ-in Ra, 25 μ-in Ra, or anywhere in between 0 μ-in Ra and 32 μ-in Ra. The surfaces of the hygienic spray deflector may have a mechanical or electro type polish. In various embodiments, the hygienic spray deflector may also be surrounded by an electric heater jacket. An electric heater jacket may be used to keep pipes, the hygienic spray deflector, and/or fluid at a particular temperature (e.g., above a freezing point of a fluid), or to evaporate moisture from the surface of the deflector.

Figure 5:
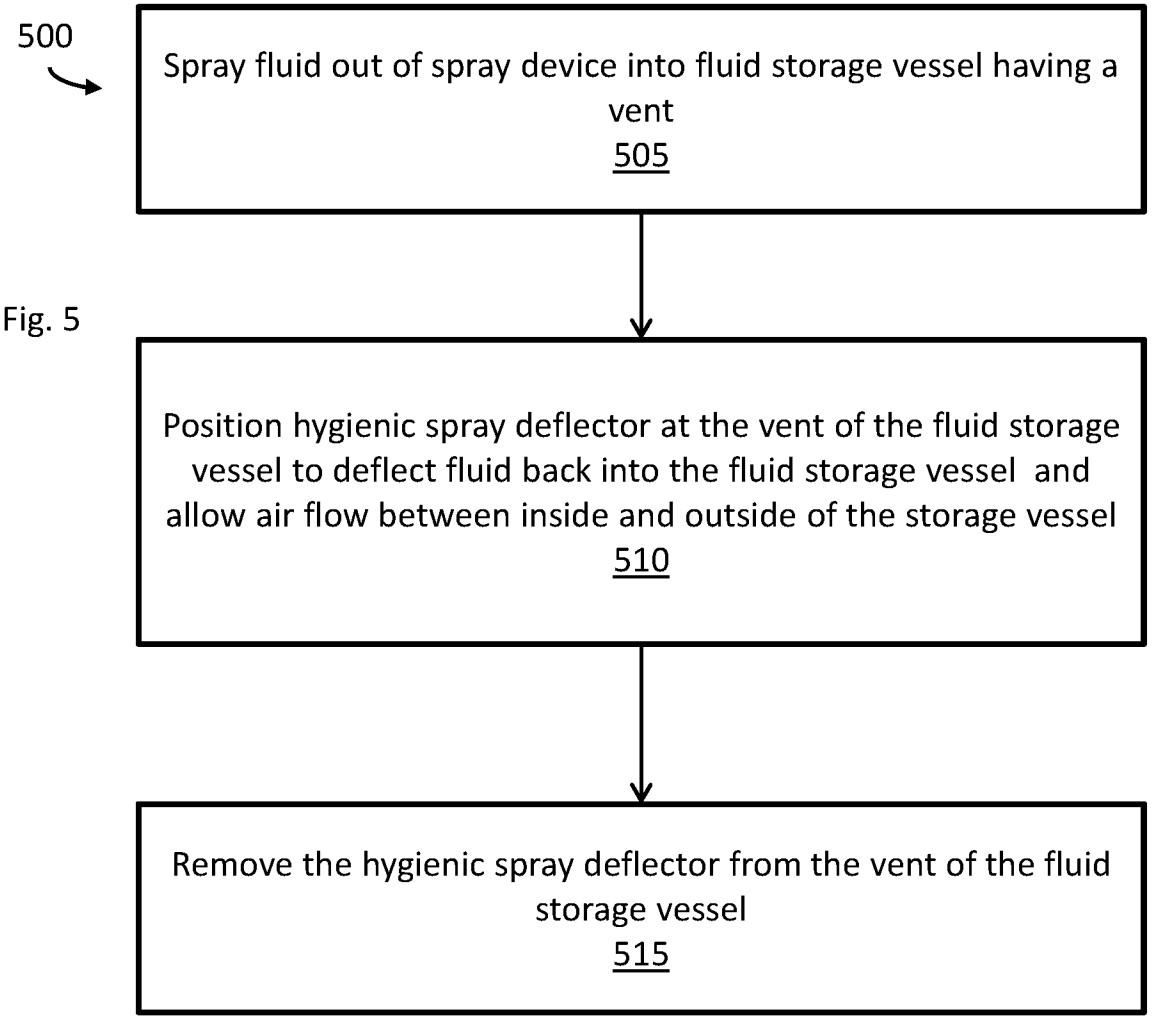
FIG. 5 is a flow diagram illustrating a method using a fluid storage vessel with a hygienic spray deflector in accordance with an illustrative embodiment.

FIG. 5 is a flow diagram illustrating a method 500 using a fluid storage vessel with a hygienic spray deflector in accordance with an illustrative embodiment. In alternative embodiments, fewer, additional, and/or different operations may be performed. Also, the use of a flow diagram is not meant to be limiting with respect to the order of operations performed.

The method 500 provides for deflecting spray fluid back into a fluid storage vessel. In an operation 505, fluid is sprayed of a spray device into a fluid storage vessel having a vent. In an operation 510, a hygienic spray deflector is positioned at the vent of the fluid storage vessel, such that fluid sprayed from the spray device that enters the vent is deflected back into the fluid storage vessel. In addition, the hygienic spray deflector is also configured to allow air flow between an inside of the fluid storage vessel and an outside of the fluid storage vessel via the vent. The hygienic spray deflector may be any hygienic spray deflector disclosed herein, such as the hygienic spray deflectors described above with respect to FIGS. 2, 3A-3C, and 4. In an operation 515, the hygienic spray deflector is removed from the vent of the fluid storage vessel. Because the hygienic spray deflectors disclosed herein are removable, they can be separated from a fluid storage vessel and any other piping for routine maintenance or cleaning, including for immersion cleaning procedures.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

The embodiments, illustratively described herein may suitably be practiced in the absence of any element or elements, limitation or limitations, not specifically disclosed herein. Thus, for example, the terms "comprising," "including," "containing," etc. shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

The present disclosure is not to be limited in terms of the particular embodiments described in this application. Many modifications and variations can be made without departing from its spirit and scope, as will be apparent to those skilled in the art. Functionally equivalent methods and compositions within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can of course vary. It is also to be understood that the terminology used herein is for the purpose of describing particular embodiments only, and is not intended to be limiting.

Other embodiments are set forth in the following claims.

What is claimed is:

1. A spray deflector apparatus comprising:
an inlet opening;
an outlet opening;
at least one wall that encloses a space between the inlet opening and the outlet opening;
a spray deflector disposed entirely within the space between the inlet opening and the outlet opening at a fixed position within the space,
wherein:
the spray deflector is configured to deflect fluid that enters the spray deflector apparatus through the inlet opening,
the spray deflector comprises a disk having a concave shape oriented toward the inlet opening,
the at least one wall is a cylindrical wall that decreases gradually in inner diameter in the direction from the outlet opening toward the inlet opening; and
a connector between the spray deflector and the at least one wall,
wherein:
the connector is configured to fix the spray deflector in place within the space, and
the connector is configured to allow air flow between the inlet opening and the outlet opening; and
an outlet pipe located at the outlet opening,
wherein:
a portion of the outlet pipe forms the outlet opening and
the outlet pipe extends into the space formed by the cylindrical wall between the inlet opening and the outlet opening.

2. The spray deflector apparatus of claim 1, wherein the spray deflector comprises a disk having a convex shape oriented toward the outlet opening.

3. The spray deflector apparatus of claim 1, wherein the at least one wall is configured to cause fluid in the spray deflector apparatus to flow toward the inlet opening when the inlet opening is oriented downward toward a gravitational force.

4. The spray deflector apparatus of claim 1, wherein the cylindrical wall has a first diameter at a first point and a second diameter at a second point,
wherein:
the first point is closer to the inlet opening than the second point and
the first diameter is smaller than the second diameter.

5. The spray deflector apparatus of claim 4, wherein the cylindrical wall at the first point forms the inlet opening.

6. The spray deflector apparatus of claim 4, wherein the spray deflector has a third diameter that is larger than the first diameter and smaller than the second diameter.

7. The spray deflector apparatus of claim 1, wherein a first diameter of the outlet pipe is smaller than a second diameter of the cylindrical wall such that at least a second portion of the outlet pipe is within the cylindrical wall.

8. The spray deflector apparatus of claim 1, wherein the at least one wall further comprises a connector wall that extends from an outer surface of the outlet pipe to the cylindrical wall.

9. The spray deflector apparatus of claim 8, wherein the spray deflector is attached to the connector wall.

10. A spray deflection system comprising:
a fluid storage vessel having a vent;
a spray device inside the fluid storage vessel; and
a spray deflector apparatus attached to the vent, the spray deflector comprising:
an inlet opening connected to the vent;
an outlet opening;
at least one wall that encloses a space between the inlet opening and the outlet opening;
a spray deflector disposed entirely within the space between the inlet opening and the outlet opening at a fixed position within the space,
wherein:
the spray deflector is configured to deflect fluid that enters the spray deflector apparatus through the inlet opening,
the spray deflector comprises a disk having a concave shape oriented toward the inlet opening,
the at least one wall is a cylindrical wall that decreases gradually in inner diameter in the direction from the outlet opening toward the inlet opening; and
a connector between the spray deflector and the at least one wall,
wherein:
the connector is configured to fix the spray deflector in place within the space, and
the connector is configured to allow air flow between the inlet opening and the outlet opening; and
an outlet pipe located at the outlet opening,
wherein:
a portion of the outlet pipe forms the outlet opening and
the outlet pipe extends into the space formed by the cylindrical wall between the inlet opening and the outlet opening.

11. The spray deflection system of claim 10, wherein the spray deflector is configured to deflect fluid sprayed into the fluid storage vessel by the spray device back into the fluid storage vessel.

12. The spray deflection system of claim 10, wherein an area of the spray deflector is larger than an area of the inlet opening.

13. The spray deflection system of claim 12, wherein the area of the spray deflector is larger than an area of the outlet opening.

* * * * *